United States Patent [19]

Castonguay et al.

[11] Patent Number: 4,736,174

[45] Date of Patent: Apr. 5, 1988

[54] MOLDED CASE CIRCUIT BREAKER OPERATING MECHANISM

[75] Inventors: Roger N. Castonguay, Terryville; David J. Meiners, Southington, both of Conn.

[73] Assignee: General Electric Company, New York, N.Y.

[21] Appl. No.: 41,566

[22] Filed: Apr. 23, 1987

[51] Int. Cl.[4] ..... H01H 9/20

[52] U.S. Cl. ..... 335/167; 335/169; 335/190; 335/172

[58] Field of Search ..... 335/166, 167, 169, 171, 335/172, 168, 190, 174, 191, 35, 8, 9, 10, 189

[56] References Cited

U.S. PATENT DOCUMENTS 4,513,268 4/1985 Seymour et al. ..... 335/35
4,622,530 11/1986 Ciarcia et al. ..... 335/167
4,679,016 7/1987 Ciarcia et al. ..... 335/172

FOREIGN PATENT DOCUMENTS 852357 3/1939 France ..... 335/190

*Primary Examiner*—Clifford C. Shaw
*Assistant Examiner*—Lincoln Donovan
*Attorney, Agent, or Firm*—Richard A. Menelly; Walter C. Bernkopf; Fred Jacob

[57] ABSTRACT

A circuit breaker operating mechanism for automated assembly finds application within circuit breakers of different ampere ratings. The circuit breaker contacts are opened and closed by means of a roller connected to the circuit breaker operating handle through a cradle link and a cam arranged on the movable contact carrier. The operating springs, cradle and latch are first assembled to the operating mechanism prior to assembly of the operating mechanism within the breaker housing.

15 Claims, 11 Drawing Sheets

MOLDED CASE CIRCUIT BREAKER OPERATING MECHANISM

BACKGROUND OF THE INVENTION

Automated assembly of the component parts used within molded case circuit breakers suggests an attractive reduction in circuit breaker assembly time and a corresponding increase in the circuit breaker calibration yield. An automated circuit breaker design for residential type circuit breakers is found within U.S. Pat. No. 4,513,268, which patent is incorporated herein for reference purposes. The relatively small number of parts used within the residential circuit breaker design facilitates assembling the components in a completely automated process.

With larger ampere-rated circuit breakers, such as used within lighting panelboards commonly employed within industrial buildings, both the number of components and the component size are larger than those required for residential application. One example of a lighting panelboard circuit breaker design that is partly assembled on automatic equipment is found within U.S. Pat. No. 4,622,530, entitled "Circuit Breaker Assembly For High Speed Manufacture", which patent is incorporated herein for purposes of reference. The circuit breaker is assembled, in part, on automated equipment by first arranging the circuit breaker components within a plurality of sub-assemblies by hand in an off-line assembly process.

Molded case, industrial-rated circuit breakers containing either thermal-magnetic or electronic trip units are not currently designed for high speed assembly processes. Due to the large number of components required within the operating mechanism, trip unit and latch assembly, a skilled operator is needed to assemble the component parts and to individually calibrate the complete breaker before shipment. Since component parts of differing size are required for the various ampere-rated circuit breaker designs, a large inventory of component parts for each ampere rating must be maintained. The size of the components is scaled in proportion to the ampacity requirements for each of the circuit breaker ampere ratings.

One purpose of the instant invention is to describe a circuit breaker operating mechanism used within the large industrial-rated breakers, which operating mechanism is mainly manually assembled in an automated manufacturing process.

SUMMARY OF THE INVENTION

An operating mechanism for industrial-rated molded case circuit breakers is mainly assembled on automated assembly equipment. The operating mechanism consists of a cradle sub-assembly and a latch sub-assembly which are first assembled in an off-line process and are later robotically assembled to the operating mechanism side frames. The operating springs are automatically loaded on to the operating mechanism and are "charged" by rotation of the cradle sub-assembly. The completed operating mechanism, including the latch and cradle sub-assemblies, is then assembled to the circuit breaker crossbar mounted within the circuit breaker case.

DESCRIPTION OF THE PREFERRED EMBODIMENT

Figure 1:
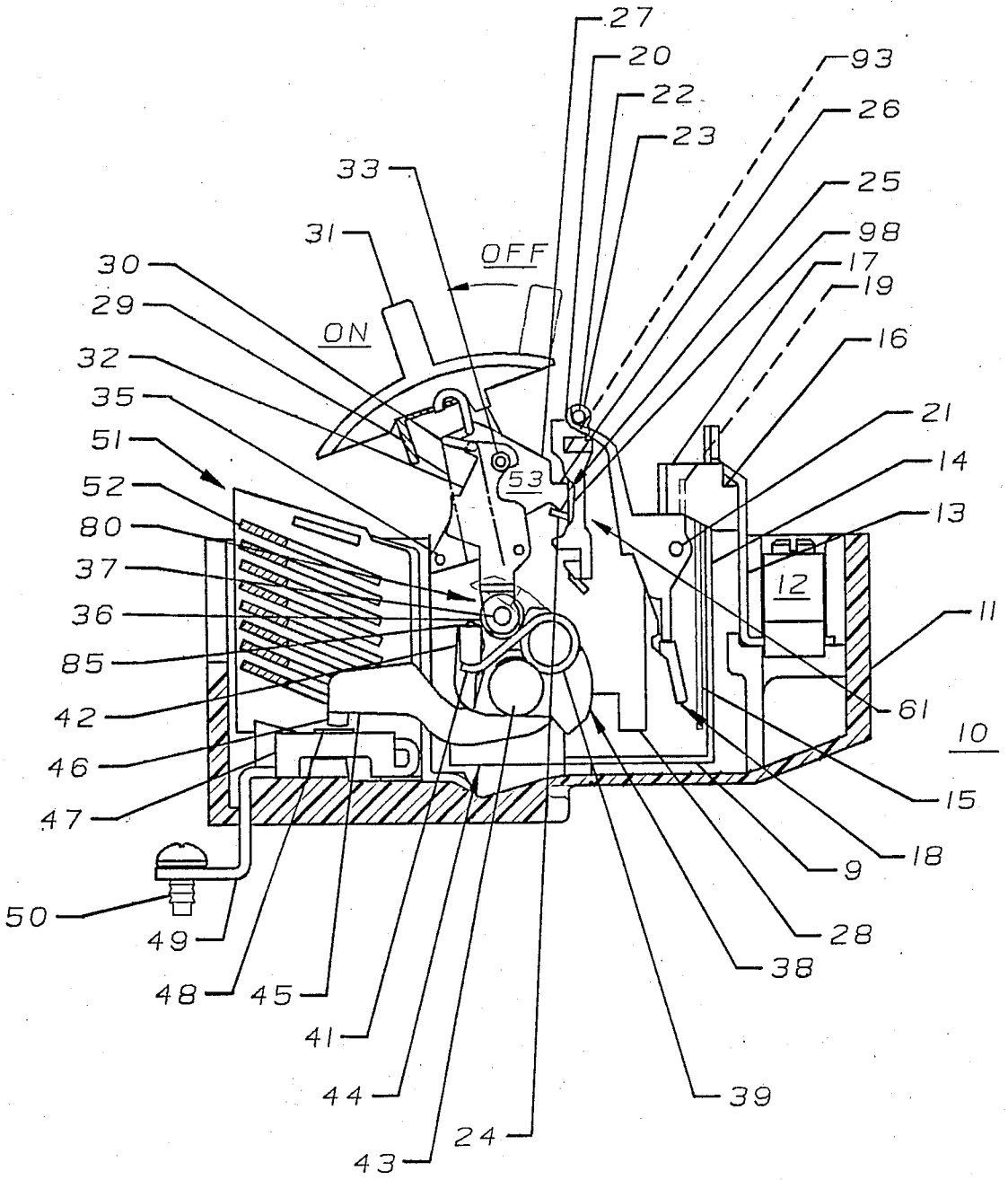
FIG. 1 is a side view of a molded case circuit breaker which includes the operating mechanism according to the invention with the cover removed.

A circuit breaker 10 is shown in FIG. 1, consisting of a molded plastic case 11 within which is arranged a load terminal lug 12 to which a heater 14 is connected through a load strap 13. The heater, in turn, is welded or brazed to a conductor strap 9, which forms part of the contact carrier support 44. A movable contact carrier 45 is slidably arranged within the contact carrier support to allow for movement of the movable contact 46 in and out of electrical connection with a stationary contact 48. The stationary contact is brazed or welded to the stationary contact support 47, which connects with the line terminal screw 50 by means of line strap 49. The so-called "long time" overcurrent trip facility is provided by means of a bimetal 15 brazed or welded to the heater 14 at one end for movement of the bimetal into contact with a trip bar 18 when relatively minor overcurrent conditions persist for selected periods of time. The trip bar includes an extension 20, partially encompassing the secondary latch pin 22 at one end, which latch pin forms part of the circuit breaker latch assembly 61. Displacement of the circuit breaker secondary latch pin articulates the circuit breaker operating mechanism, generally depicted at 80, in the following manner. The trip bar extension 20 displaces the secondary latch pin 22, causing the secondary latch 23 to rotate clockwise and move the secondary latch detent 93 out of interference with the primary latch 25. The cradle hook 26 is simultaneously released from within the primary latch slot 98 and allows the cradle 27 to swing counterclockwise about the cradle pivot 35, thereby allowing the operating springs 30 to drive the cradle links 32 and roller 36 in the counterclockwise direction thereby rapidly rotating the crossbar 38, crossbar cam 85 and the movable contact carrier 45 in the clockwise direction to cause the movable contact 46 to separate from the stationary contact 48. "Short time" overcurrent protection is provided by the circuit breaker magnet 16, which responds when higher overcurrent conditions exist for short periods of time by attracting the armature 17 into contact with the extension 19 formed on the top surface of the trip bar, causing the trip bar to rotate about the trip bar pivot 21 to articulate the operating mechanism in the manner described earlier. When the contacts become separated, the arc which forms between the contacts is rapidly motivated out to within the arc chute 51 wherein it is rapidly quenched by means of a plurality of arc plates 52 arranged therein.

When the breaker is in the "ON" position depicted in FIG. 1, the movable contact carrier 45 is biased in the counterclockwise direction by means of a contact spring 39 arranged on the crossbar 38. The crossbar is pivotally supported within the circuit breaker case by means of a pair of cylinders 43 integrally formed within the crossbar and arranged on either side thereof. The contact spring is secured to the crossbar by retention of the spring legs 41 under a pair of detents 42 integrally formed within the crossbar. The operating springs 30 are attached at one end to the roller 36 at the bottom end of the cradle links 32 and at an opposite end to the handle yoke 29 to which the operating handle 31 is attached. A detailed description of the assembly and operation of the crossbar is found within U.S. patent application Ser. No. 003,002, entitled "Crossbar Assembly". A detailed description of the contact carrier support 44 and the movable contact carrier 45 is found within U.S. patent application Ser. No. 941,974, entitled "Molded Case Circuit Breaker Contact Arrangements". Both of these Applications are incorporated herein for reference purposes.

To facilitate the automated assembly of the circuit breaker components, several of the components are operatively connected together to form a plurality of sub-assemblies which are subsequently assembled together within the circuit breaker case. The cradle sub-assembly 53, depicted in FIG. 2, consists of a pair of cradle links 32, one on either side of the cradle 27. The cradle is attached to the cradle links by means of a cradle link pivot pin 33 and is restrained from rotation in a counterclockwise rotation, as viewed in FIG. 2, by means of a stop pin 55 connecting the cradle links together. The cradle links are shaped to contain a bottom offset portion 59 between which the roller 36 is arranged for rotation about a pin 37 which also serves to anchor the operating springs. The top end of the cradle links define an angled projection 54, which interferes with a surface 57 formed in the sideframe mounting block 34. The cradle is pivotally attached to the bottom of the mounting block by means of a pivot pin 35. The mounting block has a top offset 58 and a bottom offset 59 which allow the mounting block to be attached to the operating mechanism support frame 28 shown in FIG. 3. Also formed on the front surface of the mounting block is a radial cam surface 110 for guiding a corresponding cam follower surface 56 formed on the cradle links 32 to assist in the opening action of the operating mechanism.

Figure 3:
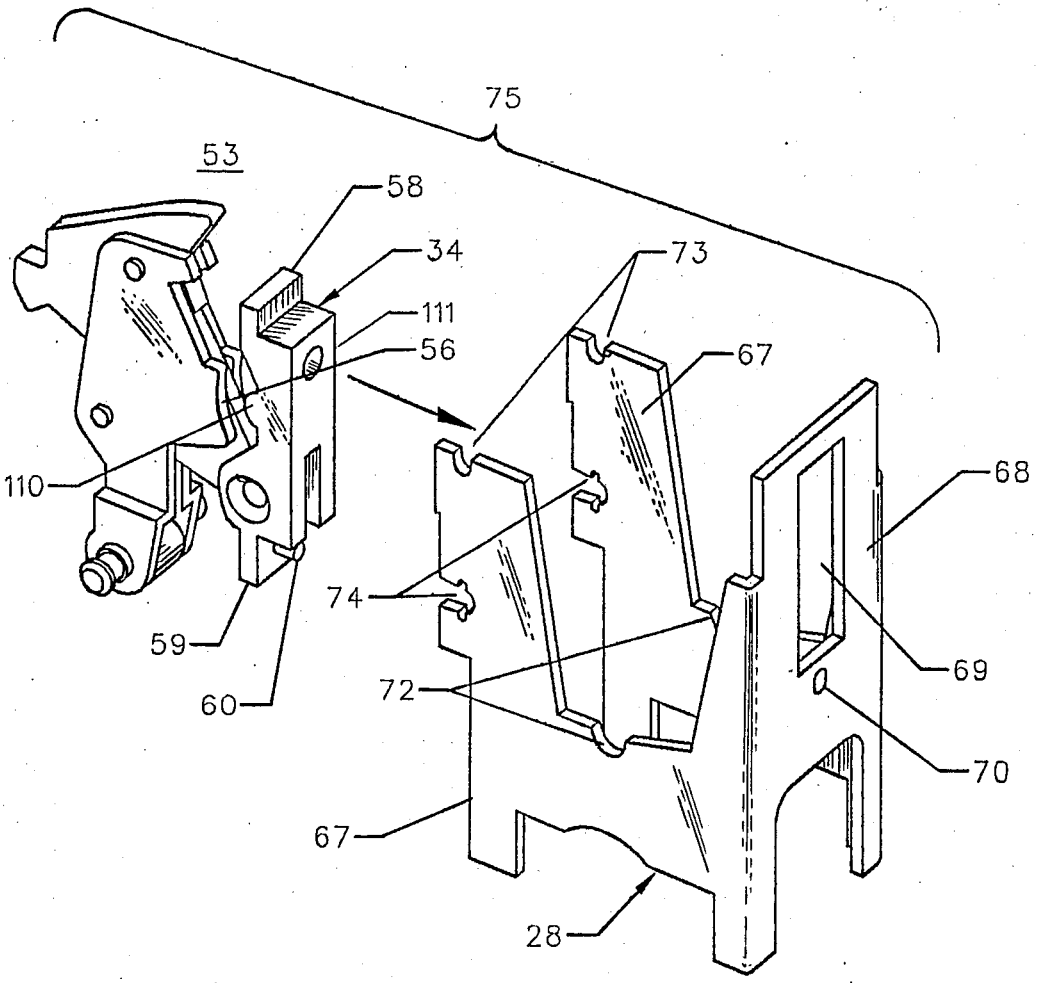
FIG. 3 is a top perspective view of the cradle sub-assembly of FIG. 2 in isometric projection from the operating mechanism side frame.
Figure 4:
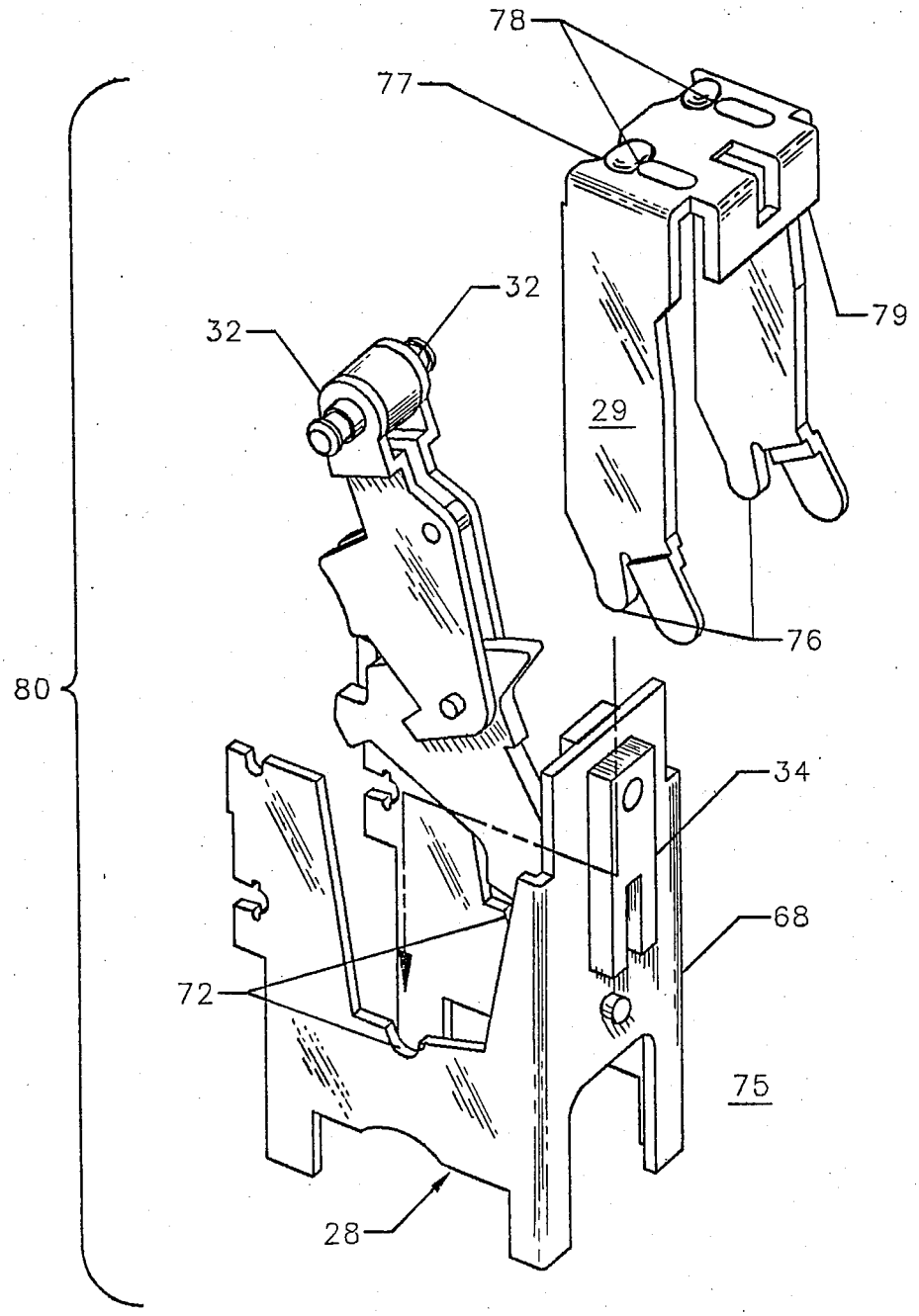
FIG. 4 is a top perspective view of the cradle sub-assembly arranged within the side frame with the operating handle yoke in isometric projection.

The attachment of the cradle sub-assembly 53 to the operating mechanism support frame 28 is best seen by referring now to FIG. 3. The cradle sub-assembly 53, when attached to the mechanism support frame, forms the operating mechanism sub-assembly 75. To facilitate the attachment of the cradle sub-assembly to the mechanism support frame, the mechanism support frame is rotated 90° clockwise from the vertical position depicted in FIG. 1 such that a rectangular aperture 69 formed in the back 68 of the mechanism support frame receives the mounting block 34, which is inserted within the rectangular opening, such that the body 111 of the mounting block extends within the rectangular opening and the top and bottom offsets 58, 59 bottom against the back 68 of the mechanism support frame. To facilitate the positioning of the mounting block within the rectangular opening, a locating pin 60 extends from the bottom offset 59 and is received within a guide hole 70 formed through the back 68. The mechanism support frame is formed from a single piece of cold rolled steel, which is shaped into a pair of sideframes 67 joined by the back 68, as indicated. A pair of slots 72 are formed on the sideframes to support the handle yoke 29, shown earlier in FIG. 1. A pair of slots 74 are formed on the ends of the sideframes opposite the back and a pair of slots 73 are formed in the top surface thereof to support the latch assembly 61, also shown earlier in FIG. 1. Once the cradle sub-assembly is attached to the support frame, the support frame is uprighted by rotating 90° in the counterclockwise direction to the position shown in FIG. 4, and the handle yoke 29 is attached by positioning the bottom of the yoke legs 76 within the slots 72 formed on the sideframes. The arrangement of the handle yoke and cradle sub-assembly within the operating mechanism sub-assembly 75 constitutes the operating mechanism-handle yoke sub-assembly 80.

Figure 2:
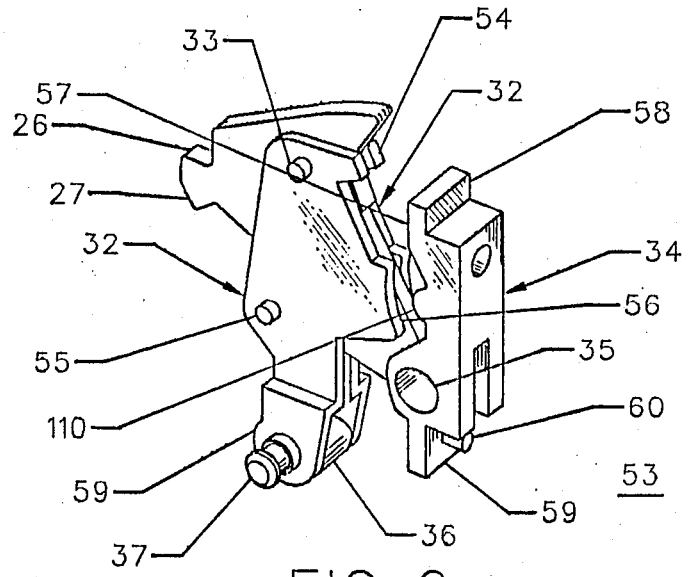
FIG. 2 is a top perspective view of the cradle sub-assembly within the operating mechanism of FIG. 1.
Figure 5:
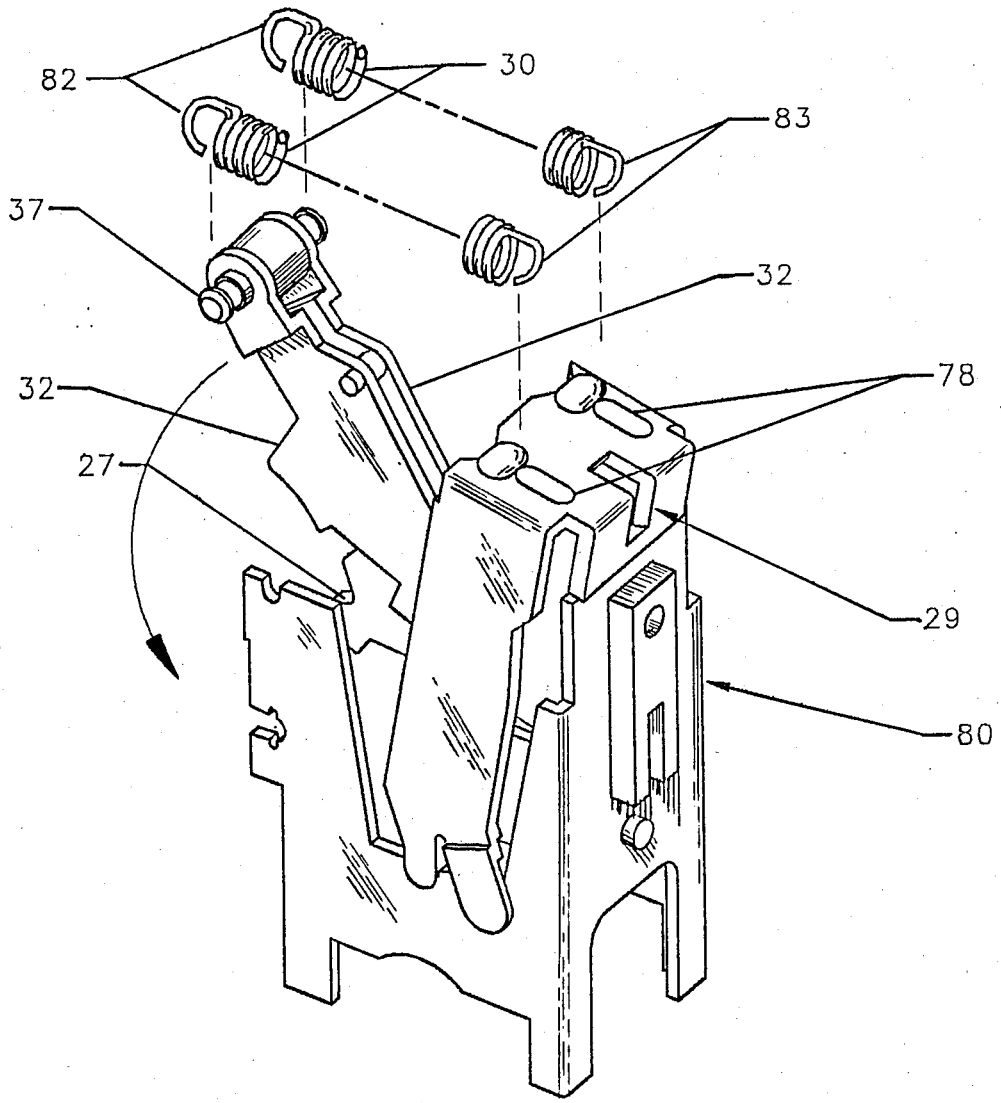
FIG. 5 is a top perspective view of the assembled operating mechanism of FIG. 4 with the operating springs in isometric projection.

The operating springs 30 are next assembled by positioning them above the operating mechanism-handle yoke sub-assembly 80 as depicted in FIG. 5 with the top and bottom hooked ends 82, 83 of the springs aligned above the roller pivot pin 37 and handle yoke slots 78 respectively. The operating cradle 27 and cradle links 32 are extended in the vertical direction as indicated. The spring ends 82 are hooked onto the roller pivot pin 37 and the spring ends 83 are hooked onto the edges of the slots 78 formed within the handle yoke. The cradle links are then rotated counterclockwise as indicated to "charge" the operating springs by stretching the springs to the overcenter condition, shown in FIG. 6. While rotating the cradle links 32 in the counterclockwise direction, the angled projection 54 on cradle links 32 interact with the surface 57 on mounting block 34, as best seen in FIG. 2, to position the angled projections 54 on the upper links against the top of projection 58 on the mounting block 34. The cradle 27 is held in the position shown in FIG. 6 against the bias of the charged operating springs by the engagement of the angled projections 54 against the top edge of the mounting block surface 58, as indicated.

Figure 6:
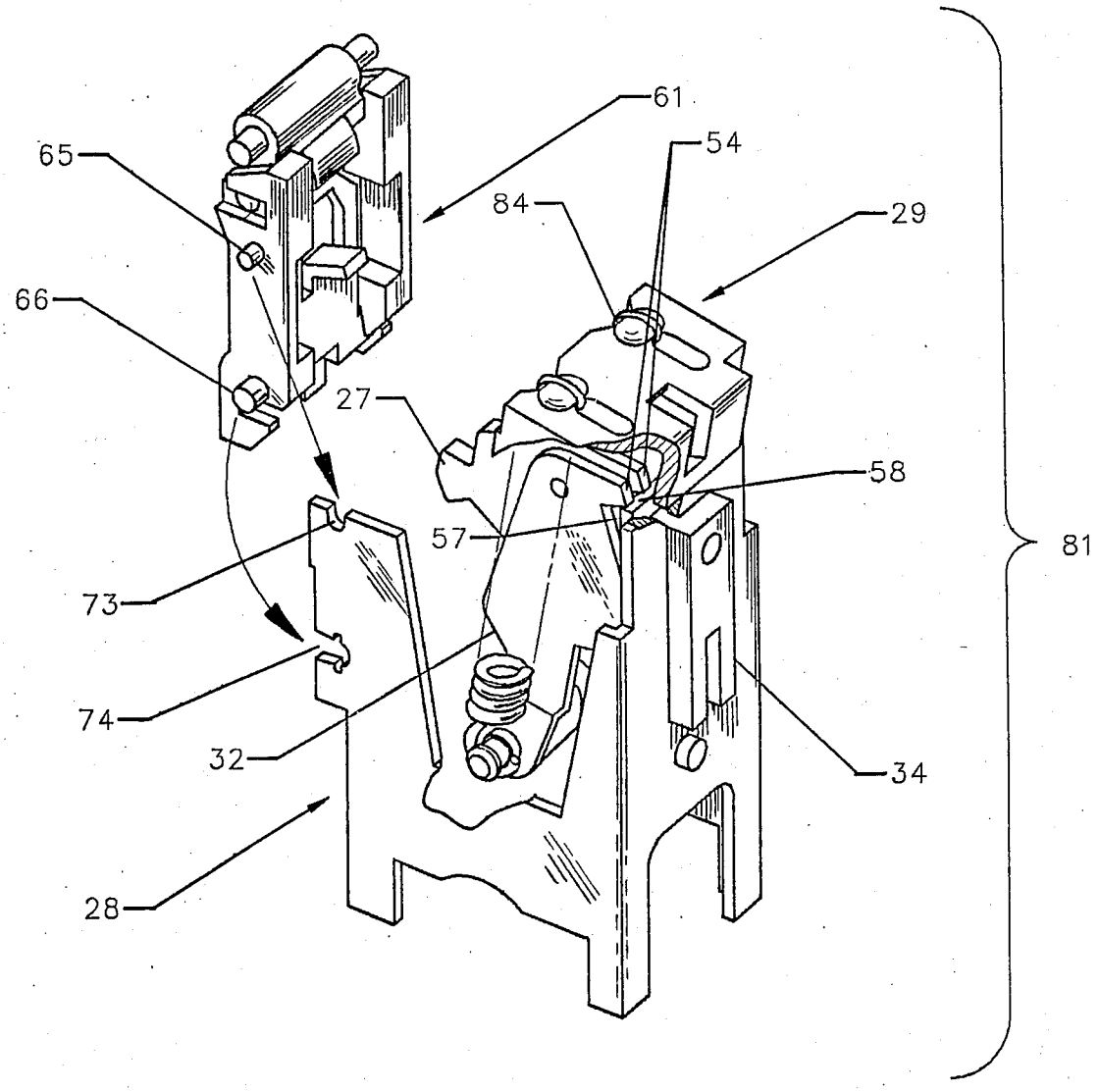
FIG. 6 is a top perspective view of the operating mechanism assembly of FIG. 5 with the latch sub-assembly in isometric projection.

Still referring to FIG. 6, the latch sub-assembly 61 is then attached to the support frame 28 by inserting the latch pivots 65 on the latch sub-assembly within the slots 73 and aligning the latch assembly support posts 66 on the latch sub-assembly within the slots 74 formed on the back surface of the support frame. The ends of the support posts are then formed over to lock the latch in position and to provide added support to the support frame 28. The arrangement of the cradle link sub-assembly and handle yoke in the position depicted in FIG. 5 is an important part of the instant invention. Heretofore, it was virtually impossible to load the operating springs to a circuit breaker operating mechanism by using mechanical means to simultaneously load and charge the operating springs to the operating mechanism assembly.

Figure 9:
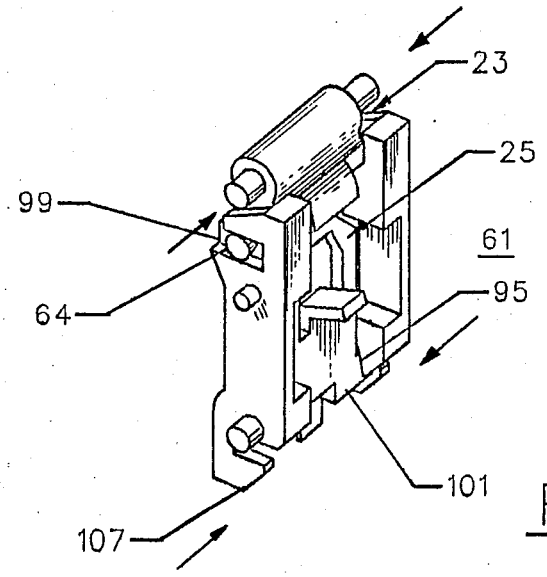
FIG. 9 is a top perspective view of the assembled latch sub-assembly of FIG. 8.
Figure 10:
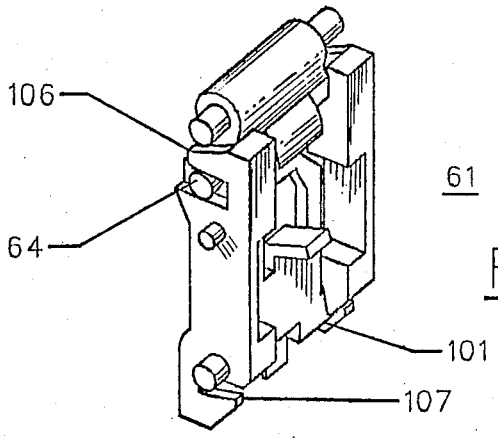
FIG. 10 is a top perspective view of the assembled latch sub-assembly of FIG. 9 with the latch sideframe tabs bent to retain both the secondary latch and the primary latch within the sideframes.
Figure 7:
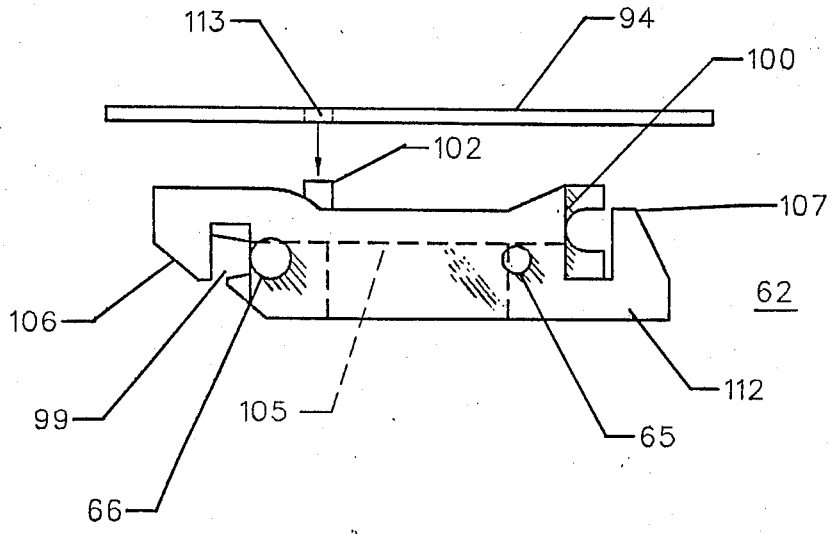
FIG. 7 is a side view of the primary latch within the circuit breaker of FIG. 1 with the latch spring shown prior to attachment.
Figure 8:
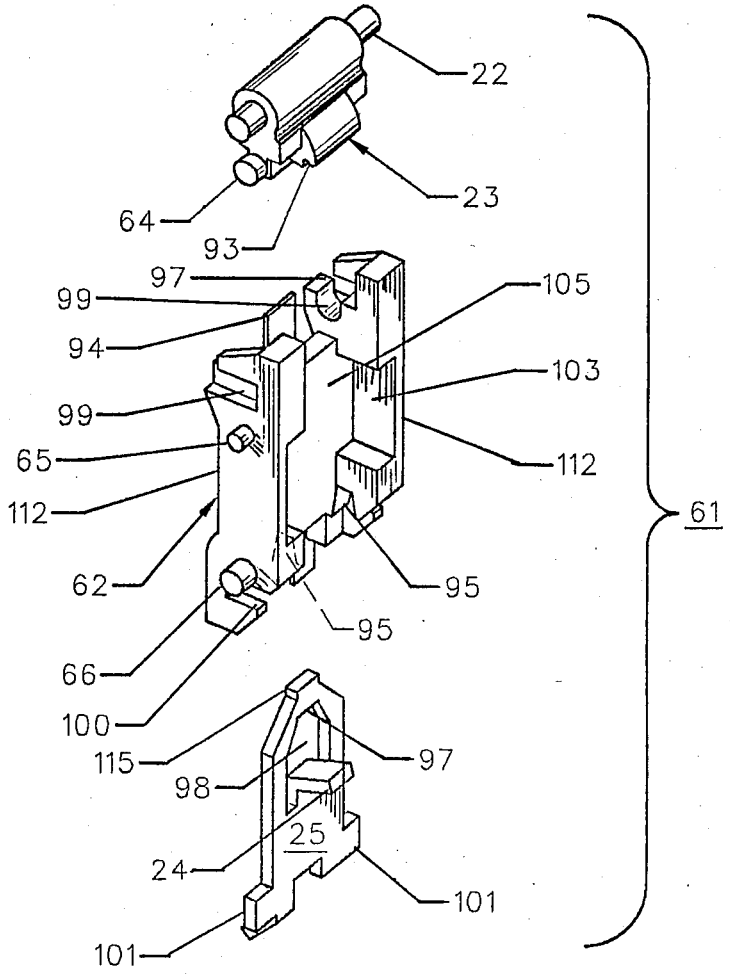
FIG. 8 is a top perspective view, in isometric projection, of the latch sub-assembly within the circuit breaker of FIG 1.

The build-up of the latch assembly 61 is depicted in FIGS. 7–10, as follows. The unitary latch sideframe 62, formed by a metal casting process, has a secondary latch support slot 99 formed at one end and a primary latch support slot 100 formed at an opposite end thereof, as shown in FIG. 7. The unitary latch sideframe 62 consists of a pair of sidewalls 112 joined by means of a crossplate 105. A stud 102, formed within the crossplate, receives the latch spring 94 by positioning the aperture 113 formed within the latch spring over the stud and riveting the stud over. The pivots 65 are integrally formed within the sideframe and extend outboard thereof at the top, while the latch assembly support posts 66 extend on both sides of the sideframe at the bottom thereof. A pair of tabs 106 are formed at the bottom of the sideframe while a similar pair of tabs 107 are formed at the top thereof to secure the primary and secondary latches to the sideframe. The sideframe 62 is arranged in the vertical plane, as represented in FIG. 8, such that the secondary latch pivot 64, integrally formed within the secondary latch 23, is inserted within the complementary slots 99 integrally formed within the sideframe, thereby positioning the secondary latch in abutment with one end of the latch spring 94. A detent 93 is formed within a bottom surface of the secondary latch to cooperate with a latch piece 115 formed on the back surface of the primary latch 25, as shown in FIG. 8. The secondary latch pin 22, extending from both ends of the secondary latch, forces the secondary latch to rotate about its pivot 64 against the bias provided by the latch spring when the latch pin is contacted by the trip bar extension 20, described earlier with reference to FIG. 1. The primary latch 25 is next loaded to the sideframe by inserting the tabs 101, formed at the bottom of the primary latch, within the complementary primary latch support slots 95, formed within the bottom of the sideframe 62. The primary latch then nests within the recess 103 defined within the sideframe and abuts the crossplate 105 such that the primary latch tab 24 extends outwardly away from the back plate. A primary latch slot 98, formed above the primary latch tab, defines a primary latch surface 97 at one edge thereof. The complete latch sub-assembly 61 is shown in FIG. 9 with the secondary latch 23 supported on the sideframe by capturing the secondary latch pivot 64 within slots 99. The primary latch 25 is supported on the sideframe by capturing the support tabs 101 on the primary latch within slots 95. To retain the primary and secondary latches within the sideframe, the top tabs 106 and bottom tabs 107 are bent inwards as indicated to lock the secondary latch pivot 64 and the primary latch support tabs 101 within their respective slots, as shown in FIG. 10.

Figure 11:
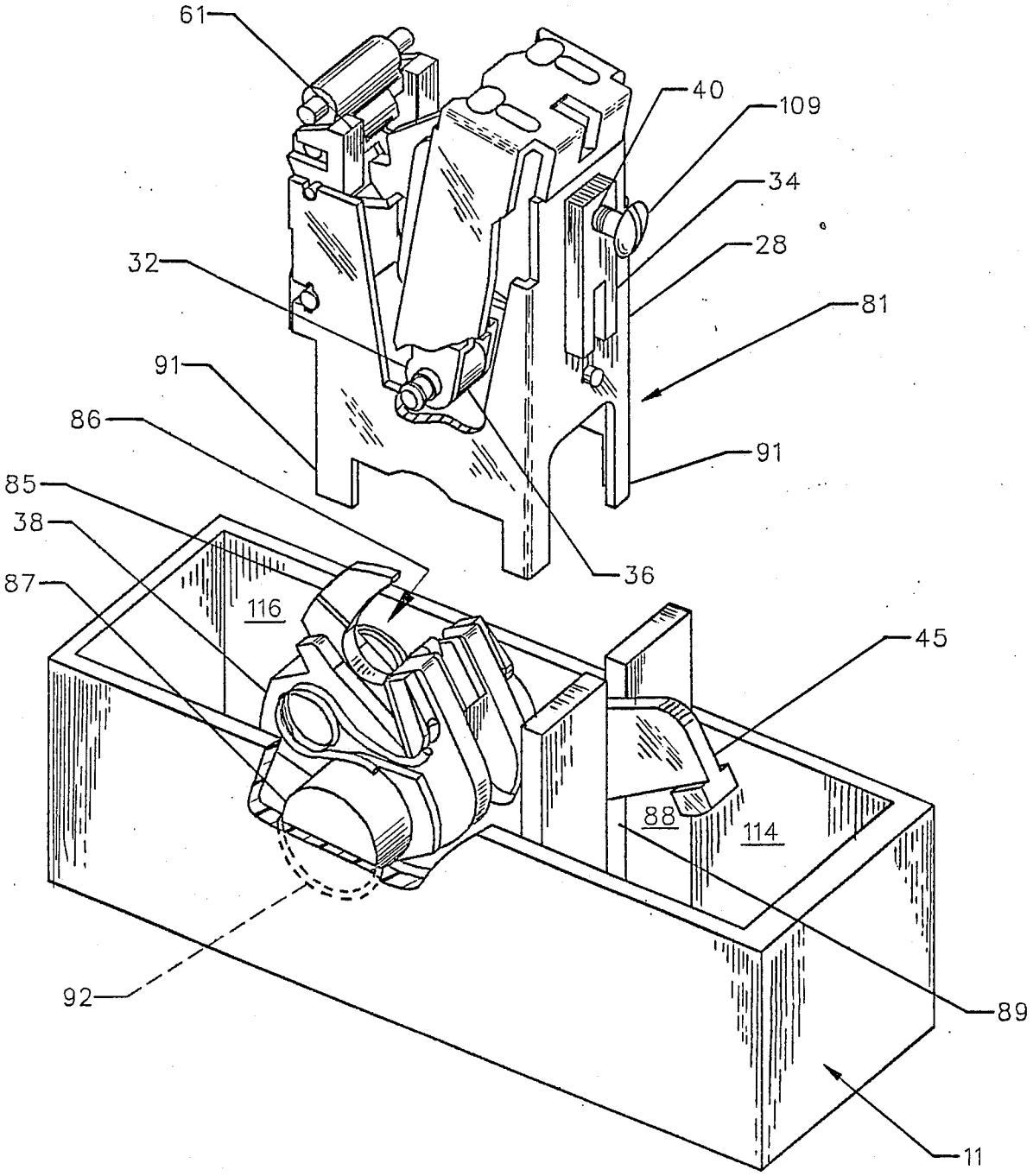
FIG. 11 is a top view, in partial section, of the circuit breaker case of FIG. 1 with the operating mechanism assembly in isometric projection.

The operating mechanism-handle yoke sub-assembly 81 is assembled within the circuit breaker case 11 in the manner depicted in FIG. 11. The roller 36 extending below the cradle links 32 is inserted within the slot 86 formed within the crossbar cam 85 within the crossbar 38 previously inserted within the casing by inserting the cylinders 87 integrally formed within the crossbar within complementary slots 92 formed in the circuit breaker case. The legs 91 on the bottom of the operating mechanism support frame 28 rest on the bottom surface of the breaker case. The contact carrier 45 extends through a slot 89 formed within the inner wall 88 that separates the two circuit breaker compartments 116, 114. The shank portion of a screw 109 is trapped within the slot 89 formed in the case and the screw is threadingly fastened within a hole 40 formed within the mounted plate 34 to secure the entire mechanism to the breaker.

Figure 12:
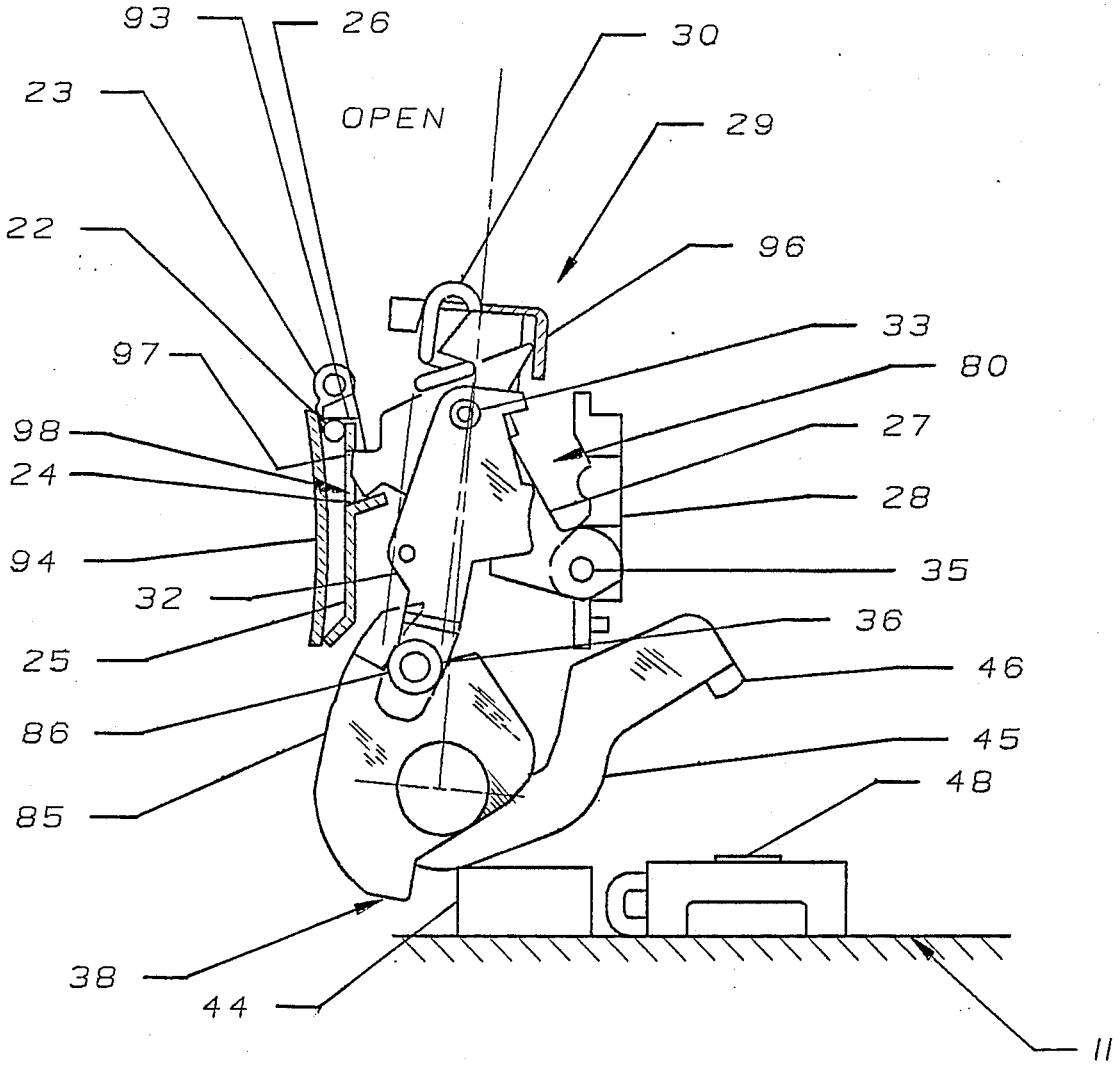
FIG 12 is a side view of the movable contact carrier, crossbar and operating mechanism of FIG. 1 with the contacts in an "OPEN" position.
Figure 13:
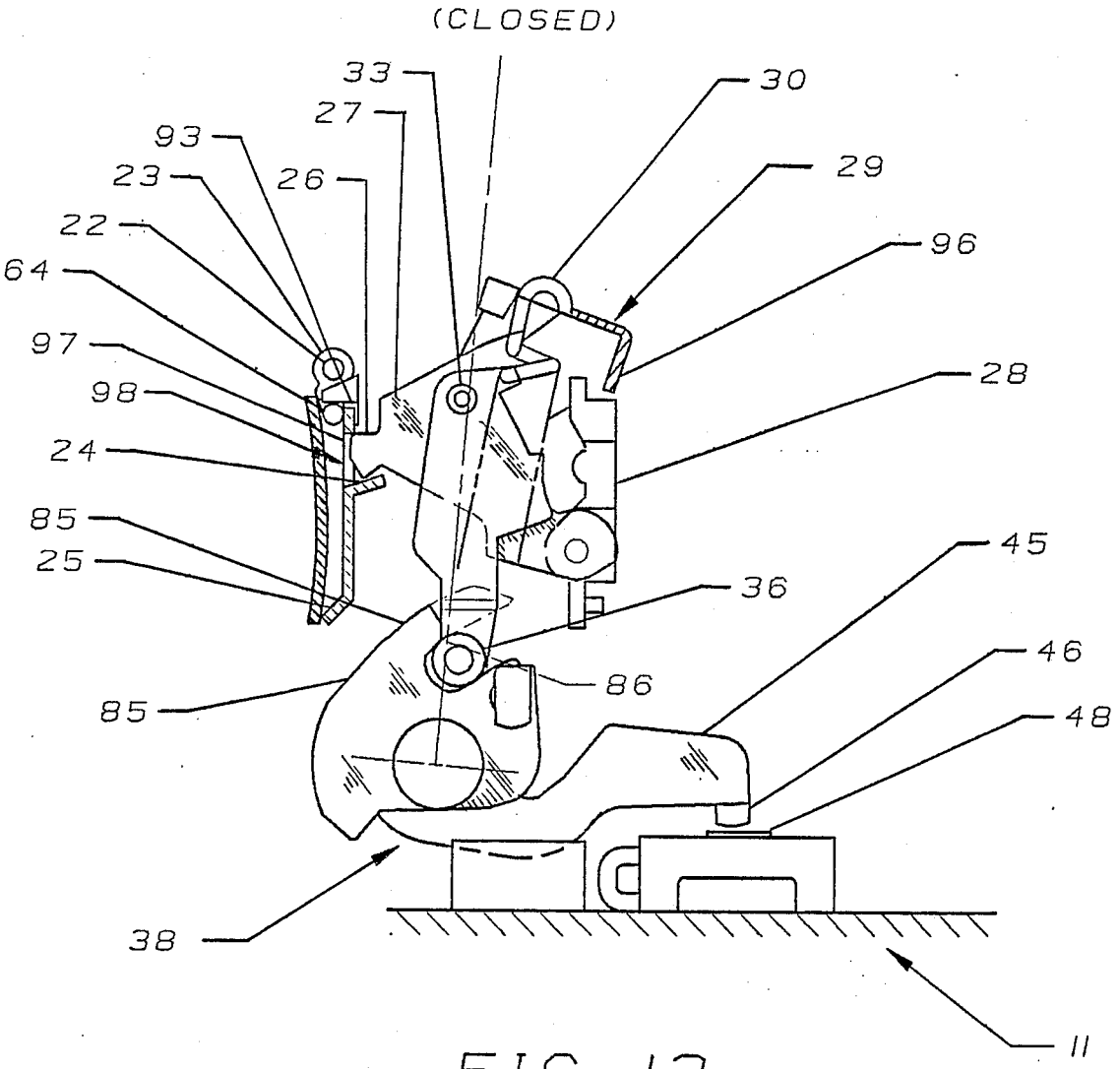
FIG. 13 is a side view of the movable contact carrier, crossbar and operating mechanism of FIG. 1 with the contact in a "CLOSED" position.
Figure 14:
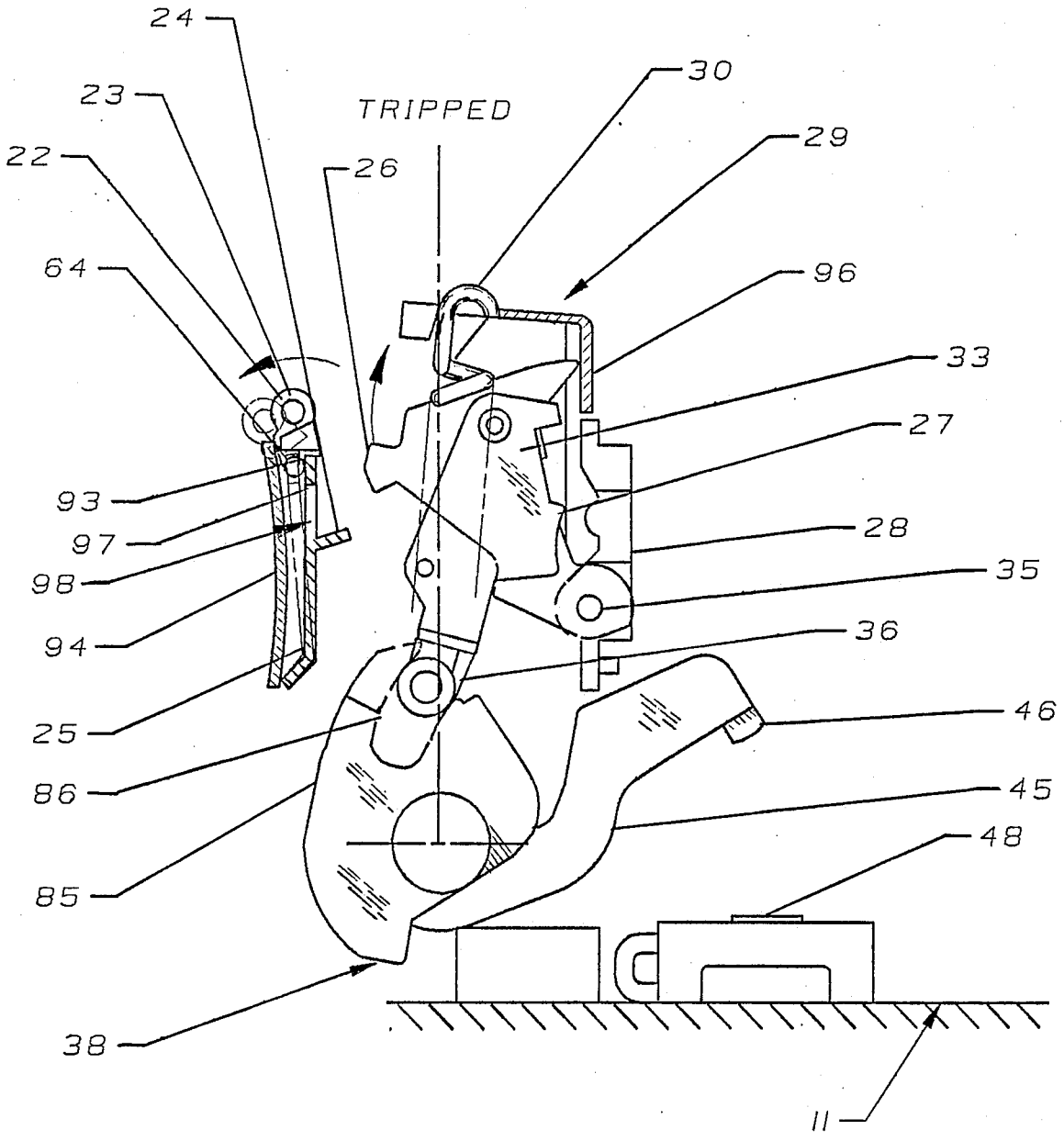
FIG. 14 is a side view of the movable contact carrier, crossbar and operating mechanism of FIG. 1 with the contacts in a "TRIPPED" position.

The interaction between the operating mechanism-handle yoke sub-assembly 81, latch sub-assembly 61 and crossbar 38 can be seen by referring now to FIGS. 12–14 which depict the circuit breaker with the contacts in an open, closed and trip position respectively. In the circuit breaker open contact position, shown in FIG. 12, the handle yoke 29 is positioned to the left of an imaginary center line through the axis of the cradle pivot pin 33 causing the roller 36 and links 32 to rotate in the clockwise direction under the urgence of the extended mechanism springs 30. The roller 36 attached to the cradle links 32 and trapped within the camming slot 86 formed within the crossbar cam 85 drives the crossbar 38 in a counterclockwise direction forcing the contact carrier 45 to an open position. The cradle 27 is held from rotating about the pivot pin 35 on the mechanism support frame 28 by interference between the cradle hook 26 and the primary latch surface 97 at the top of the primary latch slot 98 within the primary latch 25. The position of the operating springs 30, one of which is removed to better show the cradle 27 and the cradle links 32, provides a bias on the operating cradle to rotate the cradle in a clockwise direction about the pivot pin 35. The secondary latch detent 93 on the secondary latch 23 further prevents the rotation of the cradle by retaining the primary latch 25. The latch spring 94 contacts both the primary and secondary latches 23, 25, as indicated.

Movement of the handle yoke 29 to the right of the center line of cradle pivot pin 33 drives the roller 36 within the camming slot 86, causing the crossbar 38 and cam 85 to rotate in the clockwise direction. This forces the movable contact carrier 45 to rotate clockwise to the closed position shown in FIG. 13 with the movable contact 46 in abutment with the stationary contact 48. The cradle links rotate counterclockwise about the cradle link pivot pin 33 while the cradle 27 remains stationary, keeping the cradle hook 26 under the primary latch surface 97, and with the primary and secondary latches 25, 23 in the same position shown earlier in FIG. 12.

When the secondary latch pin 22 is driven in the indicated direction, the secondary latch 23 rotates counterclockwise about the secondary latch pivot 64, as indicated in phantom in FIG. 14, and allows the primary latch 25 to correspondingly rotate counterclockwise, as also indicated in phantom. The primary latch surface 97 is withdrawn from the cradle hook 26, thereby allowing the cradle 27 to rotate about the pivot pin 35. The cradle links 32 are rapidly driven upward by the operating springs 30, forcing the roller 36 up along the cam follower slot 86, driving the cam 85, crossbar 38 and movable contact carrier 45 in the counterclockwise direction. The rotation of the movable contact carrier brings the movable contact 46 out of abutment with the stationary contact 48. To reset the circuit breaker from its tripped to its latched position, the operating handle yoke 29 is moved past the open position indicated in FIG. 12 until the cradle hook 26 contacts the primary latch tab 24, which rotates the secondary latch 23 under the bias provided by the latch spring 94, thereby positioning the primary latch 25 in front of the secondary latch detent 93.

An industrial-rated molded case circuit breaker operating mechanism designed for high speed automated assembly has thus been described. The arrangement of the operating components and their method of assembly facilitates the automated assembly process.

Having thus described our invention, what we claim as new and desire to secure by Letters Patent is:

1. A molded case circuit breaker comprising:
an insulated case;
a first contact within said case attached to one end of a movable contact carrier, an opposite end of said movable contact carrier being electrically connected with a load strap;
a second contact within said case electrically connected with a line strap;
a trip unit proximate said load strap for sensing electric current through said contacts and responding to an overcurrent condition through said contacts; and
a spring-biased operating mechanism operatively connected with said movable contact carrier and a latch assembly for moving said movable contact carrier and said first contact away from said second contact to interrupt said electric current upon occurrence of said overcurrent condition;
said latch assembly comprising a sideframe support member having a secondary latch member pivotally attached at a top thereof and a primary latch member pivotally attached to said sideframe member under said secondary latch member, said secondary latch member having a detent integrally formed therein and interfering with rotational motion of said primary latch member, said primary latch member having an opening with a tab member under said opening extending toward said operating mechanism, whereby an end of a cradle pivotally attached within said operating mechanism extends through said primary latch opening and engages an edge of said opening to hold said cradle from rotating against said operating mechanism spring bias until said secondary latch is contacted by said trip unit to displace said secondary latch detent from said primary latch.

2. The circuit breaker of claim 1 wherein said sideframe comprises a unitary metal casting having a first pair of slots arranged through top ends of a pair of corresponding sidearms on said sideframe and wherein said secondary latch includes a first pair of studs, one of said first studs being arranged within each of said first slots, said top ends of said sidearms being displaced toward each other to trap said first studs within said first slots.

3. The circuit breaker of claim 2 wherein said second studs are formed over within said second slots whereby said second studs provide support to said sideframes.

4. The circuit breaker of claim 2 further including a second pair of slots arranged through bottom ends of said pair of sidearms on said sideframe and wherein said primary latch includes a second pair of studs, one of said second studs extending from each side of said primary latch, each of said second studs being arranged within each of said second slots, said bottom ends of said sidearms being displaced toward each other to trap said second studs within said second slots.

5. The circuit breaker of claim 2 wherein at least one of said second studs extends from said second latch to interact with said trip unit whereby said secondary latch becomes displaced from said primary latch to thereby cause said primary latch to rotate out from said secondary latch detent.

6. The circuit breaker of claim 1 further including a planar latch spring attached to said sideframe support member abutting said primary latch at one end of said spring and abutting said secondary latch at an opposite end of said spring.

7. The circuit breaker of claim 6 wherein said latch spring includes an aperture and said sideframe support member includes a post, said latch spring aperture being arranged over said post and said post being riveted over to retain said latch spring to said sideframe support member.

8. A molded case circuit breaker comprising:
an insulated case;
a first contact within said case attached to one end of a movable contact carrier, an opposite end of said movable contact carrier being electrically connected with a load strap;
a second contact within said case electrically connected with a line strap;
a trip unit proximate said load strap for sensing electric current through said contacts and for responding to an overcurrent condition through said contacts;
a spring-biased operating mechanism operatively connected with said movable contact carrier and a latch assembly for moving said movable contact carrier and said first contact away from said second contact to interrupt said electric current upon occurrence of said overcurrent condition;
a cradle assembly within said operating mechanism comprising a pair of shaped links hingeably attached together and to a cradle member at one end by a first pin, said cradle being arranged intermediate said links and also being hingeably attached to a support frame; and
a roller member arranged intermediate said links and attached to said links by a second pin interconnecting said links at a second end of said links opposite said first pin, said roller member being captured within a slotted cam member attached to said movable contact carrier whereby said operating mechanism rotates said movable contact carrier and said first contact away from said second contact to an open position under said spring bias upon occurrence of said overcurrent condition through said contacts.

9. The molded case circuit breaker of claim 8 wherein said links include first arcuate projections and said support frame includes a second arcuate projection, said second arcuate projection providing a cam follower surface to said first arcuate projection to thereby control the movement of said links.

10. The molded case circuit breaker of claim 9 wherein said links also include detent projections whereby a surface on said support interferes with detent projections and restrains said links from rotation against said spring bias.

11. The molded case circuit breaker of claim 8 wherein said links further include an offset at said second end defining an increased spacing between said links, said roller being positioned within said offset.

12. A molded case circuit breaker comprising:

an insulated case;

a first contact within said case attached to one end of a movable contact carrier, an opposite end of said movable contact carrier being electrically connected with a load strap;

a second contact within said case electrically connected with a line strap;

a trip unit proximate said load strap for sensing electric current through said contacts and for responding to an overcurrent condition through said contacts;

a spring-biased operating mechanism operatively connected with said movable contact carrier and a latch assembly for moving said movable contact carrier and said attached first contact away from said second contact to interrupt said electric current upon occurrence of said overcurrent condition, said operating mechanism including a support member having a pair of sideframes joined by a planar apertured back member and a cradle assembly consisting of a pair of links pivotally attached together and to a rotatable cradle member, said rotatable cradle member being also pivotally attached to a support plate secured to said back member;

a roller positioned within said links and arranged within a slotted cam connected with said movable contact carrier to move said movable contact carrier and said first contact away from said second contact under said spring bias; and a handle operator yoke pivotally supported on said pair of sideframes and carrying a pair of operating springs to provide said spring bias, one on each side of said yoke, one end of said springs being retained in slots formed within said yoke and an other end of said springs being retained by a pin through said roller.

13. The molded case circuit breaker of claim 12 further including an extension on said handle yoke and a projection on said rotatable cradle, said handle yoke extension contacting said cradle projection to thereby rotate said cradle about said links.

14. The molded case circuit breaker of claim 12 wherein said handle yoke is positioned within a pair of openings provided within said side frames.

15. The circuit breaker of claim 2 wherein said primary and secondary latch members are biased away from each other by a planar spring member.

* * * * *